United States Patent [19]

Poppi

[11] Patent Number: 4,469,013

[45] Date of Patent: Sep. 4, 1984

[54] RADIAL-PISTON HYDRAULIC MOTOR

[75] Inventor: Franco Poppi, Modena, Italy

[73] Assignee: Oliostip S.p.A., Modena, Italy

[21] Appl. No.: 366,156

[22] Filed: Apr. 7, 1982

[30] Foreign Application Priority Data

Apr. 8, 1981 [IT] Italy ..... 40038 A/81

[51] Int. Cl.[3] ..... F01B 13/06; F04B 1/28; F04B 1/14

[52] U.S. Cl. ..... 91/495; 91/497

[58] Field of Search ..... 92/118; 91/490, 488, 91/493–495

[56] References Cited

U.S. PATENT DOCUMENTS

| | | | |
|---|---|---|---|
| 368,424 | 8/1887 | Rigg | 91/497 |
| 1,308,436 | 7/1919 | Maw | 91/497 |
| 2,157,692 | 5/1939 | Doe et al. | 91/490 |
| 2,698,585 | 1/1955 | Cofner et al. | 91/495 |
| 2,918,018 | 12/1959 | Miller | 91/491 |
| 3,108,543 | 10/1963 | Gregor | 91/490 |
| 3,274,946 | 9/1966 | Simmons | 91/490 |
| 3,656,407 | 4/1972 | Hause | 91/494 |
| 3,742,819 | 7/1973 | Freese | 91/490 |
| 3,799,034 | 3/1974 | Haglund | 91/490 |
| 3,998,133 | 12/1976 | Kuroki | 91/495 |
| 4,018,139 | 9/1977 | Landreau | 91/490 |
| 4,034,651 | 7/1977 | Eickmann | 91/488 |
| 4,144,799 | 3/1979 | Donchaux | 91/488 |

FOREIGN PATENT DOCUMENTS

| | | | |
|---|---|---|---|
| 5406 | 1/1978 | Japan | 91/180 |

*Primary Examiner*—William L. Freeh

*Attorney, Agent, or Firm*—Lowe, King, Price & Becker

[57] ABSTRACT

A reversible motor includes a rectilinear shaft (1) having peripherally arranged semi-spherical cavities (24) each engaging the ball-appendage (25) of a radial cylinder (21). A related piston (28) reciprocates axially within each cylinder chamber (27) and is also furnished with a ball-appendage (29) connected within a spherical socket (30) located in a traverse (31). The traverse joins two discs (32 and 33) together whose inner cylindrical surfaces rotatably surround a pair of stationary eccentric rings (38) rotatably engaging the shaft (1). The shaft rotates by means of a drive hub connected to the actual shaft and having arms (42) in contact with a recess (43) formed in the rotating discs (33). A roller wheel (45) protruding laterally from each of the radial arms into the recess (43) transmits rotation to the drive hub. In the case of a motor with variable cubic capacity, provision is made for a pair of arms (49) with upper extremities connected to a traverse (57) and provided with a hub (50) coupling outwardly in rotation with the relative internal cylindrical surface of the discs (32 and/or 33). The internal surface of each hub is prismatic and coupled—with a degree of clearance—to a like prismatic outer surface of a corresponding fixed bush (52) whose inner surface couples in rotation with the shaft (1). The traverse (57) is adjustable in height in order to vary c.c. Fluid distribution is accomplished through the motor shaft.

5 Claims, 4 Drawing Figures

RADIAL-PISTON HYDRAULIC MOTOR

BACKGROUND OF THE INVENTION

The present invention relates to a reversible, radial-piston hydraulic motor driven by oil or a less viscous fluid in which propulsion is the product of fluid distribution into pistons disposed radially with respect to a motor shaft.

Reversible radial motors are known in which a crankshaft coupling between an individual cylinder (or piston) and shaft is obtained by means of a shoe of quasi-spherical profile, held tight to a motor shaft pivot by means of a pair of lateral rings, while the coupling between the individual piston (or cylinder) and motor at a peripheral location is rigid, or perhaps achieved by means of a gudgeon. Current techniques have also produced axial-flow pumps in which semispherical couplings are utilised in uniting the 'big-end' of each individual piston connecting-rod with the pump main rotating body.

The above techniques are susceptible to further improvement with regard to the following requirements: avoidance of grinding of the shoe with the shaft pivot thereby diminishing friction; elimination of eccentric weight thereby obtaining greater speeds; absence of transverse stress on cylinder/piston coupling parts and other related support components, gaining a tighter fluid seal; simplification of fluid distribution by shortening of ducts; a more simple device by means of which to vary the cubic capacity of the motor; utilization of more economical, synthetic fluids—or emulsified water, in place of oil, these being less of a pollution hazard, and either less inflammable or totally non-flammable.

It is accordingly an object of the present invention to provide a radial hydraulic motor free of eccentric weight, with a reduced degree of friction, without transverse stress on cylinder and piston couplings, and which may be run on synthetic fluids or emulsified water, and having means for varying the cubic capacity of the motor itself.

SUMMARY OF THE INVENTION

The invention utilizes a rectilinear shaft coupled to each radial cylinder by means for a spherical coupling, or ball-and-socket joint, allowing no play. Each cylinder is coupled to a piston which in turn couples by means of a like ball-and -socket arrangement to a traverse member connecting a pair of rotating discs which revolve around a fixed pair of eccentric rings coupled in rotation with the shaft itself. Transmission of drive from said pair of discs to said shaft is achieved by means of a disc fixed to the shaft itself and furnished with rollers, protruding laterally so as to engage recesses located in one of the above-mentioned discs, or vice-versa. Distribution of fluid into the cylinders is by way of the shaft having one end communicating with the hydraulic distributor. In the case of a variable c.c. motor provision is made for a pair of arms provided with a hub, at their lower extremity, the outer surfaces of which couple in rotation with the inner surfaces of the pair of discs, while at their opposite extremities the pair of arms connect with a radially-adjustable traverse to vary the cubic capacity of the motor. The hub of each of the pair of arms is provided with a prismatically-shaped internal surface, mating loosely with a like external surface of a corresponding bush disposed coaxially with respect to, and coupled in rotation with the motor shaft.

Advantages provided by the invention are the following: - less friction, less wear, and greater efficiency; a simple and compact motor weighing and costing less, and taking up less space; absence of ovality in piston/-cylinder matching; reduced vibration; diminution of load loss by dint of short distributor ducts located in the motor shaft; simplified connection between fluid distributor and the motor's rotary section; elimination of play between shaft and piston due to the hemispherical socket-lip gripping the corresponding ball beyond the equatorial girth thereof attainment of higher speeds; possibility of utilizing a less costly, less flammable or non-flammable and non-polluting hydraulic driver fluid; simplified means of varying the motor c.c. from minimum to maximum, or when idling.

BRIEF DESCRIPTION OF THE DRAWINGS

The invention will now be described, by way of example, with the aid of the four accompanying drawings in which.

DESCRIPTION OF THE PREFERRED EMBODIMENTS

Figure 1:
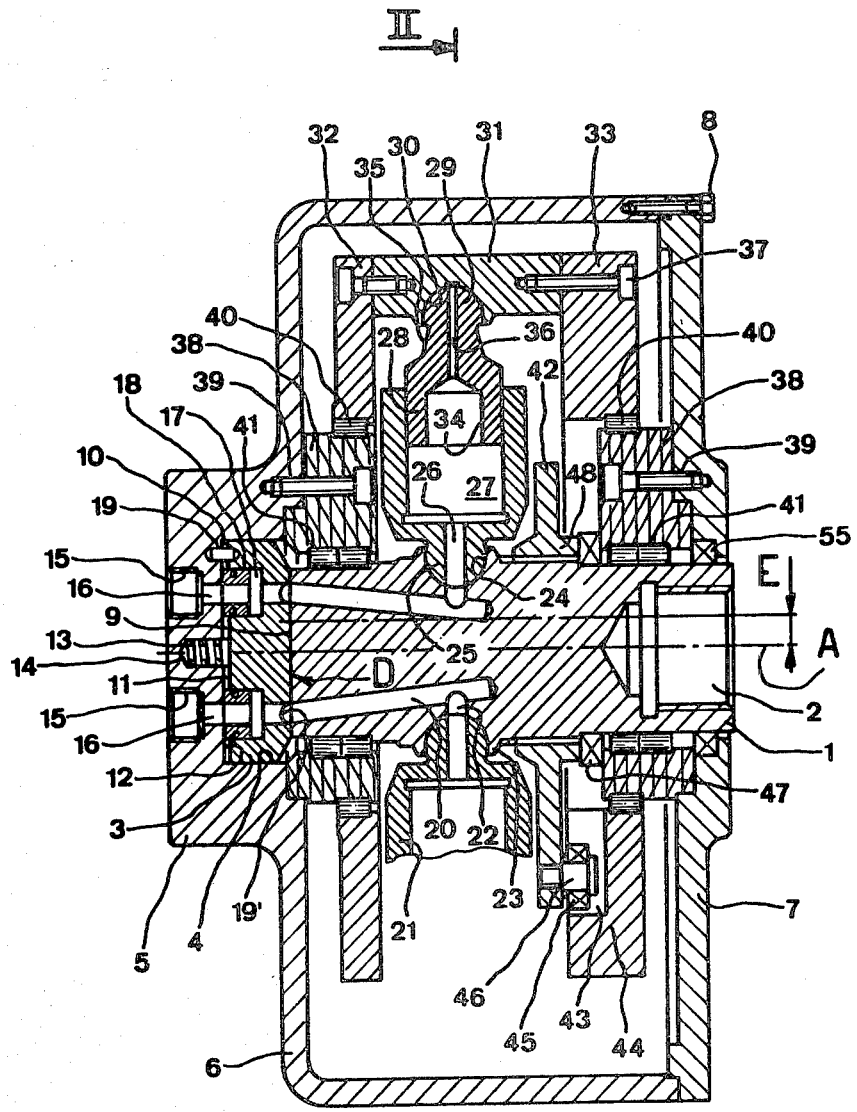
FIG. 1 is a vertical axial cross-sectional view of the motor.
Figure 2:
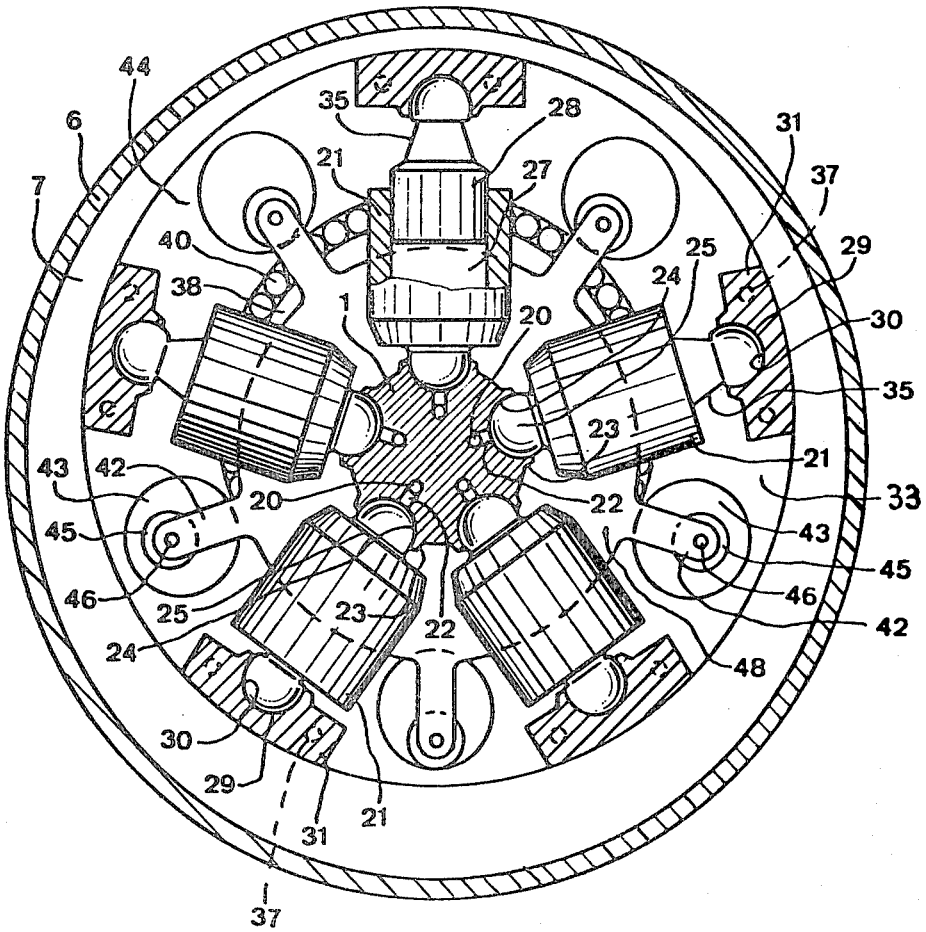
FIG. 2 is a transverse cross-sectional view of the motor in FIG. 1 taken along the line II—II.

With reference to the above drawings, rectilinear shaft 1 of the motor includes at one end thereof an internal thread 2 into which an output shaft (not shown) is screwed. A distributor body 3 is received within a seating 4 located in main hub 5 of motor casing 6 which is enclosed by cover 7 and held fast with screws 8. The front end 9 of shaft 1 abuts the forward face D of distributor body 3. A pressure overspill chamber 10 for fluid is located between rear face 11 of distributor body 3 and base 12 of seating 4. A pair of springs 13 housed in a corresponding pair of holes 14 located in base 12 serve to maintain forward face D of body 3 urged against front end 9 of shaft 1. A pair of threaded bores 15 are located in main hub 5 to connect entry and exit hoses containing pressurized hydraulic fluid to the motor. A pair of apertures 16 permit passage of the fluid between the entry and exit hoses and two compensating chambers 17 located within a pair of fluid seals 18. A rotation-inhibiting element is denoted by 19. A pair of arched distribution channels 19' are located in face D of distributor body 3. Longitudinal ducts 20 are located internally within motor shaft 1, through which fluid is forced into and discharged from radially-disposed bell-shaped cylinders 21 by way of further apertures 22. Radial projections 23 of shaft 1 define peripherally-located bosses-one to each cylinder 21—inside of which a spherical cavity 24 is formed within the shaft. The lip of cavity 24 is designed to be shrunk-riveted around the spherical appendage 25 of a corresponding cylinder 21, thereby ensuring a tight, no-clearance joint inside the cavity itself. An aperture 26 is located within spherical or ball appendage 25 of each cylinder 21 to allow passage of fluid from aperture 22 in shaft 1 into chamber 27 of the cylinder, wherein piston 28 reciprocates. Piston 28 also has a ball appendage 29 which is swivel-jointed with a corresponding ball-cavity or socket 30 so as to allow no clearance therebetween. Socket 30 is located in the boss of a respective piston-support traverse 31 which also serves as a connecting and spacer element for and between a pair of discs 32, 33. The latter boss is similar in all respects to boss 23 on shaft 1. A weight-reducing recess 34 in piston 28 communicates with a lubrication hole 36 passing through piston collar 35. Discs 32 and 33 are fastened to traverse support 31 by means of bolts 37. A pair of eccentric rings 38 are fixed to casing 6 and cover 7 respectively by means of bolts 39. Roller components 40 are distributed in peripheral fashion along the inner and outer cylindrical surfaces of the discs and rings to maintain, respectively, discs 32, 33 and eccentric rings spaced apart. Rollers 41 are distributed in like fashion between the inner cylindrical surface of each eccentric ring 38 and the correspondingly opposed cylindrical surface of shaft 1. Radial arms 42, corresponding in number to cylinders 21, are fixed to shaft 1 at a point between the output shaft-end and the cylinders to transmit drive imparted by discs 32, 33 and supports 31 to the motor shaft. Circular recesses 43 are located within portion 44 of disc 33, each accommodating a roller wheel 45 mounted onto a pivot 46 projecting out from arm 42. A bearing 47 is positioned between the hub section 48 of each arm 42 and a corresponding eccentric ring 38. E represents the extent of eccentricity possessed by rings 38 with respect to axis A of shaft 1.

Figure 3:
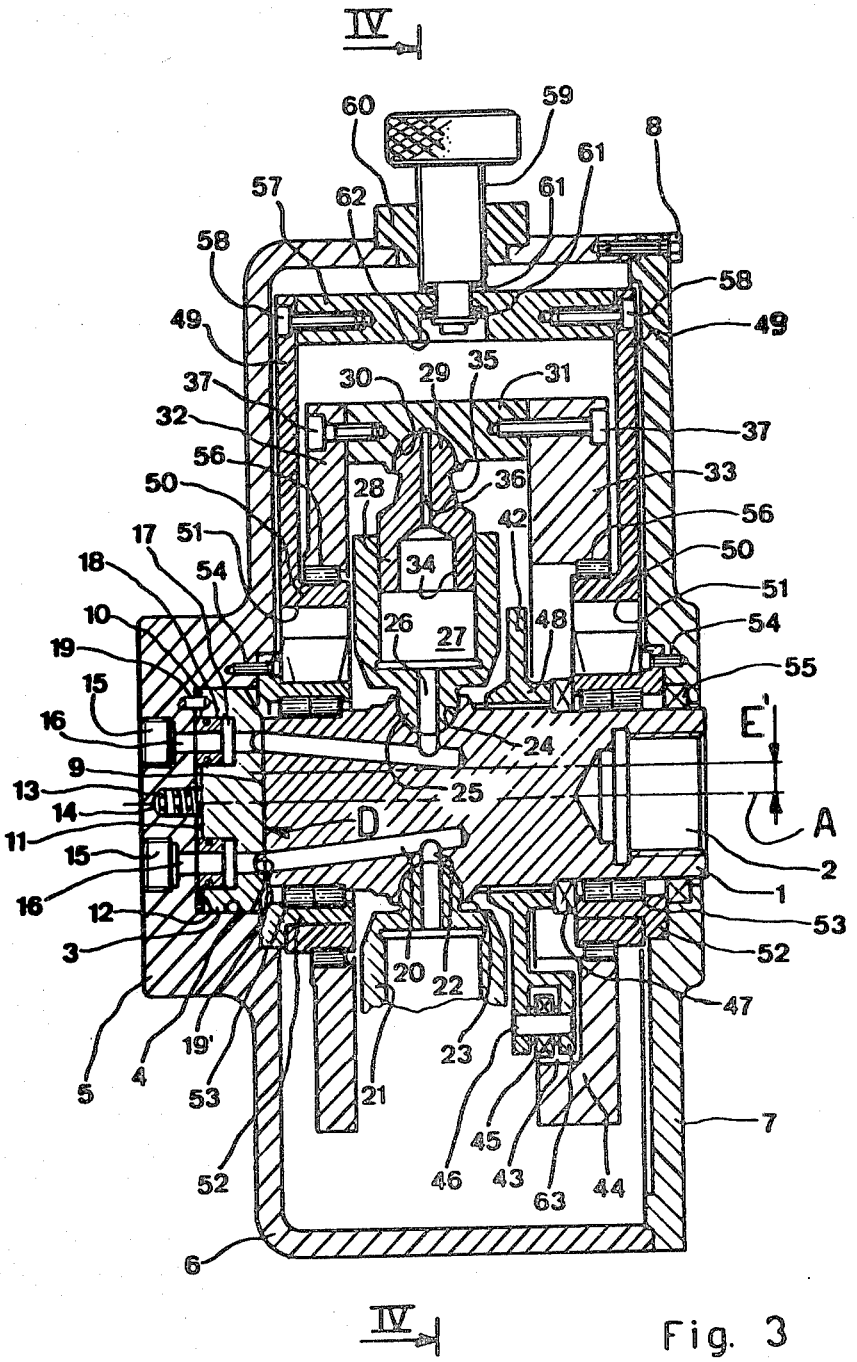
FIG. 3 is the same cross-section as in FIG. 1, though of the variable c.c. embodiment.
Figure 4:
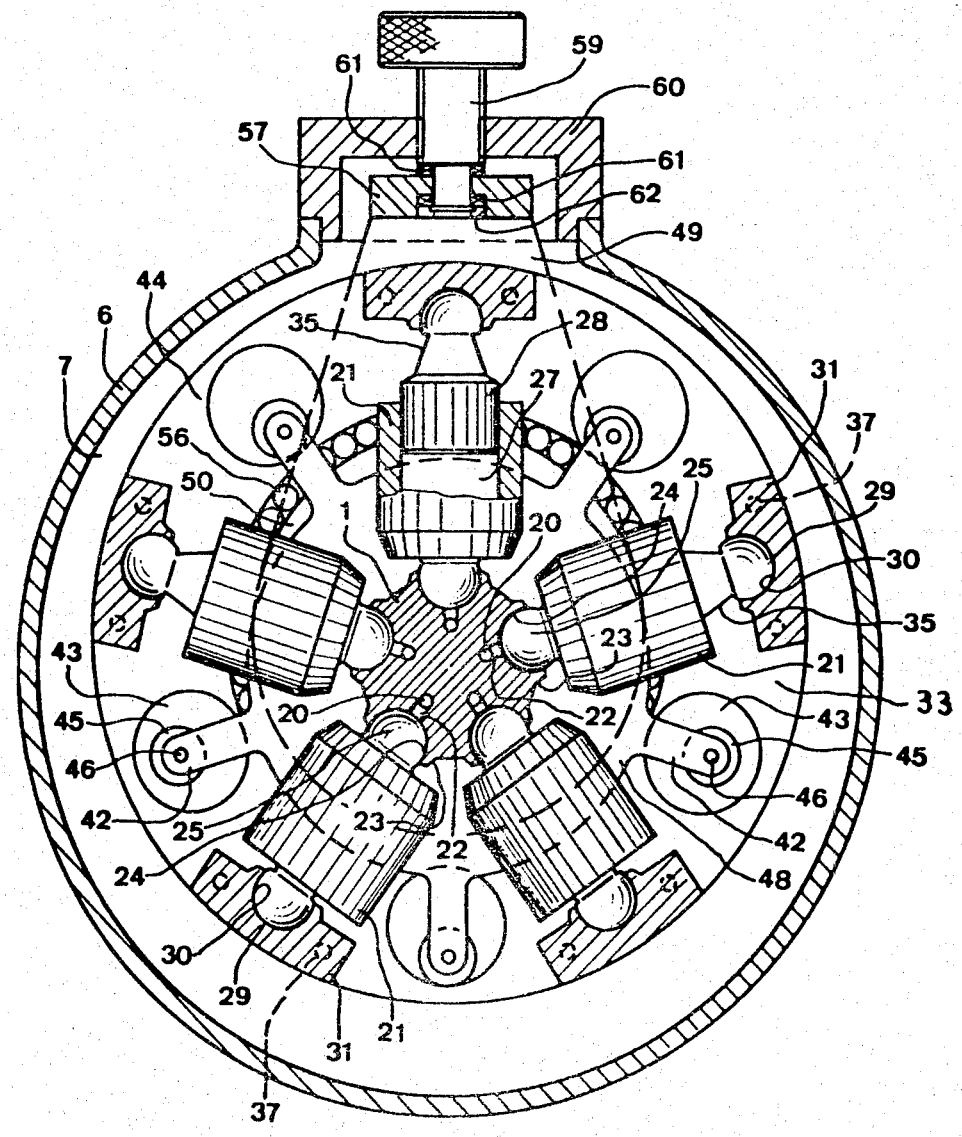
FIG. 4 is the transverse cross-section of the embodiment in FIG. 3 taken along the line IV—IV.

In the FIG. 3 embodiment, a pair of arms 49 are provided each carrying a hub 50 whose polygonal inner sleeves 51*c* over a corresponding bush 52 with a like polygonal exterior in such a way as to produce longitudinal play. The inner cylindrical surface of bush 52 is coupled in rotation with shaft 1 by means of rollers 53. Bushes 52 are fastened respectively to casing 6 and cover 7 by means of bolts 54. Hydraulic fluid seals 55 are provided. Rollers 56 positioned between the outer surface of each hub 50 and inner surface of discs 32, 33. A traverse member 57 is provided to which the free ends of arms 49 are connected by means of bolts 58. A screw-adjustment control pommel 59 engages a fixed internal thread 60 anchored to the outer face of motor casing 6 and is coupled in rotation with traverse 57 by way of axially-disposed bearings 61. An internal recess 62 located in traverse 57 accommodates the end-stop of threaded pommel-shaft 59. The function performed by this screw adjustment is that of varying the degree of eccentricity E′ of hubs 50 in order to regulate piston stroke 28—hence the motor's cubic capacity. An extra member 63 depends from arm 42 so as to form a yoke flanking roller wheel 45 for the purpose of providing relative pivot 46 with support from either side thus offering greater resistance to stresses imposed thereupon.

The motor functions in the following manner. Fluid under pressure is introduced into chamber 27 of each cylinder 21 by way of the entry hose through passages 16, 19′ and 20 and apertures 22, 26 and exerts axial thrust upon those pistons 28 in phase with the distributor entry-flow, thereby investing the assembly of discs 32, 33 and relative traverse members 31 with torque which, being transmitted through recess 43, roller wheel 45, pivot 46 and arm 42 (one such transmission link for each piston-cylinder pair and offset with respect thereto) imparts the drive necessary to uniformly rotate shaft 1. During operation, the respective ball-appendages 25 and 29 of cylinder 21 and piston 28 absorb the load and prevent transmission of transverse stress between cylinders and relative pistons by virtue of their articulation within respective sockets 24 and 30. Fluid distribution becomes especially simple due to the supply being derived from the central area through shaft 1 rather than from the periphery; in other words the distributor ducts are shorter and load loss is kept to a minimum. Furthermore, in contrast to those motors incorporating a fixed periphery, the invention makes provision for but one single sliding abuttal between the distributor body and the motor's rotary section i.e. D and 9 respectively. With regard to the variable c.c. device, by screwing or unscrewing threaded shaft 59, one achieves the respective lowering or raising up of the assembly formed by discs 32 and 33 and relative traverses 31, thereby varying the stroke of pistons 28 connected to the latter.

When carrying the invention into effect, materials, dimensions, design particulars and methods of execution may all differ from the specification while retaining the equivalent technical value and by no means straying from within the bounds of protection afforded to the invention'basic concept. Moreover the pivot 46 carrying roller wheel 45 could be fixed to disc 33 so as to protrude toward the motor's interior, and the location of recess 43 be provided for in a moulding on the disc carrying arm 42, rather than in disc 33 itself; in this event disc 33 would need to be thinner, and the disc bearing arm 42 given added depth in order to allow location of the recesses 43. Lastly, cylinders 21 and pistons 28 could be switched about, though at no gain in convenience.

What is claimed is:

1. A radial-piston hydraulic motor, comprising: casing means including hydraulic distributor means stationarily arranged therein; a series of radial cylinders connected on one side thereof to a central shaft and on the other side thereof to piston means disposed in said cylinders, said shaft having peripherally disposed bosses thereon surrounding a ballsocket adapted to mate with a ball-appendage forming part of each radial cylinder, each appendage having a fluid-supply aperture communicating with each cylinder; said piston means being a hollow piston disposed within each cylinder, each piston including a ball appendage formed with a lubricant aperture; a piston-support traverse formed with a ball socket respectively receiving the ball appendage of each piston; a pair of discs connected together by the piston support traverse, each disc having an inner cylindrical surface respectively coupled in rotation with an outer cylindrical surface of a means rotatably coupled to said shaft for imparting eccentric movement to the discs relative to the shaft; each cylinder having a fluid supply aperture communicating through a radially-disposed aperture within the shaft with a longitudinal duct formed in the shaft, the longitudinal duct communicating with an arched channel (19′) in a distributor body and means for resiliently maintaining a forward face of the distributor body in contact with an end of the shaft opposite an output end thereof.

2. A hydraulic motor according to claim 1 further including hub means coaxially mounted on said shaft between the cylinders and the eccentric means located at the output shaft-end, said hub means including radial arms each protruding therefrom into a corresponding circular recess formed within one of said discs, each pivot carrying a roller wheel engaging a cylindrical surface of the recess to transmit drive to the shaft.

3. A hydraulic motor according to claim 2 wherein said eccentric means includes a pair of elements having an outer surface rotatably supporting the disc pair, said pair of elements being a pair of hubs having two lateral arms connected together at free outer ends thereof to a traverse engaged by a screw-adjustment shaft means threaded into a thickened section of a peripheral surface of said casing, an inner surface of each said hub being prismatic and coupling with a like prismatic outer surface of a fixed bush allowing clearance therebetween, said bush disposed coaxially and rotatably coupled by an inner surface thereof to said motor shaft, whereby adjustment of said screw adjustment shaft means causes corresponding radial movement of the traverse and disc pair to selectively vary the cubic capacity of the motor.

4. The motor of claim 2, wherein said eccentric means includes plural rings each of fixed eccentricity rotatably supporting the disc pair on the motor shaft.

5. A radial-piston hydraulic motor, comprising:

(a) casing means housing hydraulic distributor means therein and a central shaft;

(b) a series of radial cylinders connected on one side thereof to the central shaft and on the other side thereof to piston means disposed in said cylinder;

(c) a pair of discs eccentrically mounted for rotation on said shaft, each disc connected to the other at free ends thereof by a traverse member;

(d) passageway means for supplying fluid from the hydraulic distributor means to each of said cylinders; and (e) means connected to transmit rotative torque from one of said discs to the central shaft, wherein each cylinder and piston is formed with a ball appendage each received within a socket formed within each of the central shaft and traverse.

* * * * *